US007878271B2

(12) United States Patent
Larbo

(10) Patent No.: US 7,878,271 B2
(45) Date of Patent: Feb. 1, 2011

(54) DRILL BIT

(75) Inventor: Göran Larbo, Sollentuna (SE)

(73) Assignee: Atlas Copco Craelius AB, Marsta (SE)

( * ) Notice: Subject to any disclaimer, the term of this patent is extended or adjusted under 35 U.S.C. 154(b) by 0 days.

(21) Appl. No.: 11/571,558

(22) PCT Filed: Jun. 22, 2005

(86) PCT No.: PCT/SE2005/000987

§ 371 (c)(1),
(2), (4) Date: Jan. 2, 2007

(87) PCT Pub. No.: WO2006/004494

PCT Pub. Date: Jan. 12, 2006

(65) Prior Publication Data

US 2007/0246266 A1 Oct. 25, 2007

(30) Foreign Application Priority Data

Jul. 1, 2004 (SE) ..... 0401703

(51) Int. Cl.
*E21B 49/02* (2006.01)
*E21B 10/00* (2006.01)

(52) U.S. Cl. ..... 175/249; 175/171; 175/402; 175/403; 175/404; 175/333; 75/229; 75/230

(58) Field of Classification Search ..... 175/171, 175/249, 402, 403, 404, 333; 75/229, 230
See application file for complete search history.

(56) References Cited

U.S. PATENT DOCUMENTS 2,996,061 A * 8/1961 Miller ..... 408/59
3,833,077 A * 9/1974 Lavallee ..... 175/325.2
4,189,015 A 2/1980 Acker et al. ..... 175/330

FOREIGN PATENT DOCUMENTS

SU 1086112 A 4/1984

* cited by examiner

*Primary Examiner*—Daniel P Stephenson
*Assistant Examiner*—Yong-Suk Ro
(74) *Attorney, Agent, or Firm*—Greenberg Traurig LLP

(57) ABSTRACT

A drill bit (20) for connection to a casing string (R), wherein the bit (20) comprises an annular bit face (21) which is built-up by a matrix and which comprises a sintered diamond-metal powder mixture, wherein the bit face (21) includes a plurality of radially orientated liquid delivery slots (16, 23, 26) for cooling and cleansing the bit face (21), wherein at least one of the liquid delivery slots is comprised of an inner slot (23) which extends radially outwards from the inside (24) of the bit face (21), wherein the slot (23) is terminated with an inner bottom (24) in the bit face (21), wherein a further liquid delivery slot comprises an outer slot (26) that extends radially inwards from the outside (27) of the bit face, and wherein said outer slot is terminated with an outer bottom (28) in the bit face (21).

7 Claims, 1 Drawing Sheet

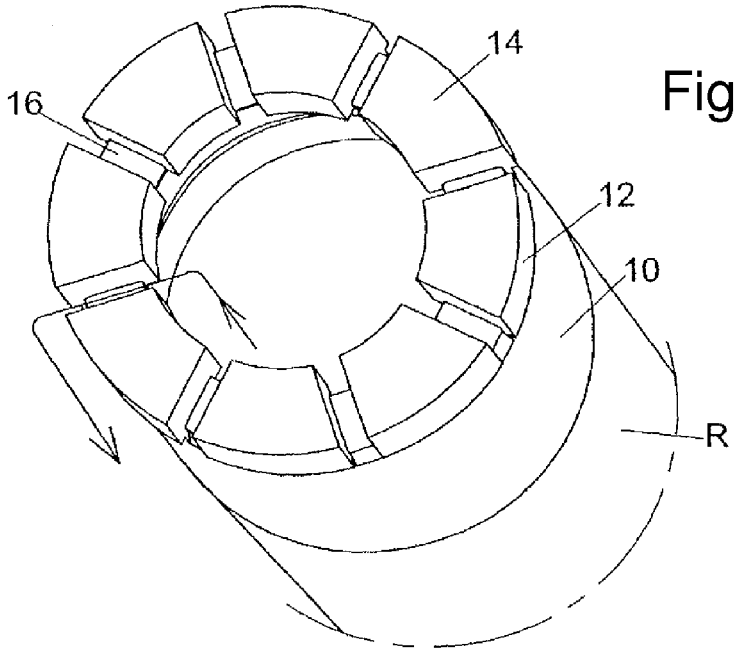
Fig 1: Prior Art
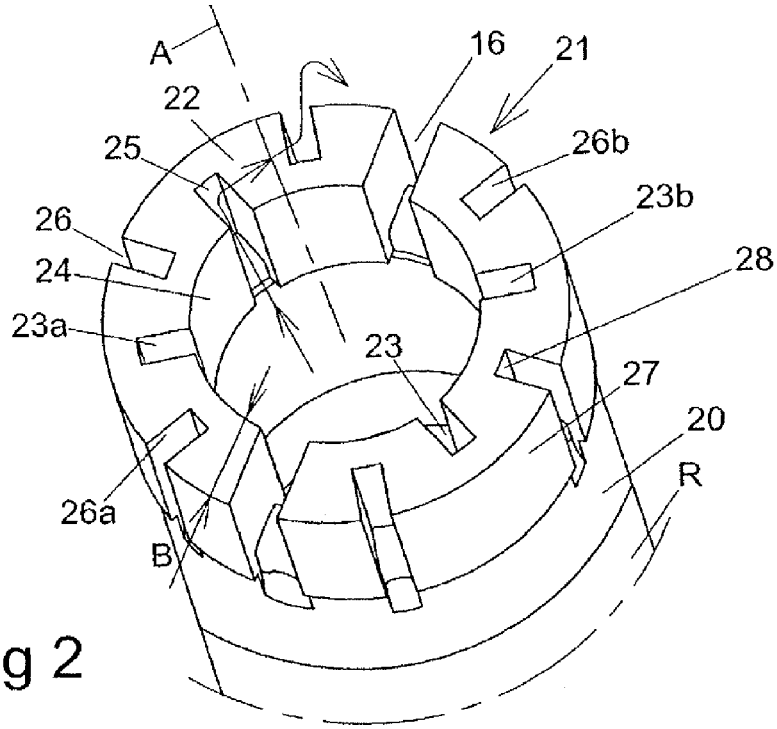
Fig 2

DRILL BIT

TECHNICAL FIELD

The present invention relates to wire-line drilling in which a tubular bit having an annular matrix at one end of a tubular casing string is adapted to cut loose a core that is lifted up through the borehole inside the casing string with the aid of a wire.

The present invention is particularly intended to solve the cooling and flushing problems that arise with increasing drilling depths when using this drilling technique.

BACKGROUND OF THE INVENTION

Core drilling is used in the investigation of rock formations, in respect of prospecting and in also in respect of many other applications, wherein the formation to be investigated is penetrated with a tubular drill which cuts a circular core from surrounding material, whereafter the core is removed from the borehole for examination. The drill normally used consists of a tubular casing string which has at its face end a drill bit of similar tubular configuration. The drill is driven into the formation by a drilling machine which rotates the casing string while forcing the string into the formation at the same time. The drill bit used will have properties that are appropriate with regard to the properties of the rock formation, although the drill bit will normally consist of a tubular steel shaft that has provided at its face end a matrix that contains hard cutting or grinding elements consisting of diamond, hardmetal or similar material. When drilling in hard rock species there is normally used a diamond bit, so as to obtain a drill crown of sufficient wear strength and length of life. The matrix consists of metal powder which has been sintered to an homogenous tubular configuration which is held intact by the abrasive particles.

Diamond-equipped drill bits are normally divided into two types, surface-inset and impregnated bits respectively. Surface-inset bits have a number of diamond crystals in the matrix surface layer and the drill is considered to be worn out when these crystals have been worn down. In the case of impregnated bits, on the other hand, the matrix powder is mixed with a large number of small diamond crystals and as the matrix becomes worn fresh diamond crystals are constantly exposed until the entire matrix has been worn away. The length of life of this latter bit is thus much longer than the former bit.

A large amount of heat is generated in the drilling operation, due to the friction acting between the matrix and the rock, and it is necessary to cool the bit constantly in order to prevent its destruction. The coolant used in this regard is normally water which is pumped through the casing string right up to the drill matrix then either returns to the borehole opening through the space defined between the wall of the borehole and the outside of the casing, or dissipates through cracks and the like in the drilled formation.

In addition to cooling the drill bit, the water is also intended to carry away sludge and slime, e.g. the crushed rock, formed in the drilling operation. These two purposes require the supply of large volumes of water, the amount required depending on the diameter on the drill bit. The gap present between the face of the bit and the rock is, of course, very small, almost nonexistent, and in order to ensure that sufficient water is delivered, the bit is provided with radially through-penetrating water-delivery slots. In order to remain functional during the entire length of life of the bit, it is necessary that these slots are equally as deep as the height of the matrix.

Core drilling is used for borehole depths of from a few meters down to a thousand meters or more. The casing string consists of a number of tubes that are screwed together as the depth of the borehole increases. Each tube will have an individual length of between 1 and 6 meters. During the drilling operation, the core is lifted up in a length that can vary from 1 meter to 6 meters or 9 meters. In the case of conventional drilling operations it is necessary to lift the entire casing string from the borehole, which in the case of deep holes takes a significant length of time, since each individual casing must be unscrewed, lifted away and then screwed together once more. The wire-line technique has been developed because of this. This development involves the use of a special catching device which is lowered by a hoist inside the casing string and grips an inner core tube that firmly holds the core and therewith enables the core to be hoisted from the borehole. This method thus enables the casing string to be kept in the hole until drilling is complete or until the drill bit is worn out, i.e. until the matrix has been consumed. It is necessary to remove the casing string from the hole in order to replace the drill bit.

It is thus highly desirous in the case of wire-line drilling that the bit has the longest possible length of life. Perhaps the most obvious way of increasing the life time of a bit is to increase the height of the matrix and at present matrix heights of up to 12 mm are used with this in mind. However, when the height is increased above this magnitude, a number of drawbacks occur.

Cooling of the bit face is effected with the aid of through-penetrating slots that extend radially in the matrix and transversely through the matrix material and through the full height of the matrix right up to the rock abutting surface of the bit face. As the height of the matrix becomes greater, the water delivering slots become deeper, wherewith a major part of the cooling and flushing water passes through the water delivery slots without reaching the cutting surface, therewith impairing cooling of the bit and also the danger of overheating, i.e. melting of the matrix increases. This quickly leads to wear.

There is also obtained a certain degree of conicity of the inner diameter due to wear, wherewith a core cut from the material during a drilling operation is liable to fasten in the drill bit when attempting to hoist up the core.

Moreover, the increasing height-width-ratio formed by the deep water-delivering slots makes the matrix segments more liable to bend, wherewith segment breakages may occur during a drilling operation.

It is earlier known from Russian patent specification SU1086112 to provide a drill bit with external and internal coolant conveying slots. However, these slots are wedge-shaped so as to create cuffing edges which result in high flushing pressures and in burning of the bit in the case of high-speed drilling in hard crystalline rock, due to an excessively low degree of cooling. The flushing holes also taper, so that the flushing effect and the degree of cooling decrease when the drill bit wears down, this being, inter alia, a problem that the present invention is intended to solve.

Furthermore, the drill face according to the Russian specification has the form of a wedge through which slots are formed in the wedge apex to the extent that the external and the internal slots extend radially beyond the wedge apex. The height of the through-penetrating part is also very small, meaning that the through-penetrating slots will have disappeared, when the matrix has worn down by only 10 percent. The geometry of the drill bit is thus quite different from the geometry of the inventive drill bit.

OBJECT OF THE INVENTION

The aim of the present invention is to provide another type of drill bit that solves the problems indicated above and encountered with known drill bits.

A drill bit according to the present invention is designed such that the bit face will comprise a much higher matrix that has earlier been possible. This has been done so that a bit can be produced for use down to borehole depths of up to 500-1000 meters or more without being worn out in the process, although while maintaining the same degree of cooling and flushing, primarily with wire-line-drilling using diamond-impregnated bits when drilling at high speeds in hard crystalline rock.

SUMMARY OF THE INVENTION

This aim is achieved by means of the present invention as defined in the independent claims. Suitable embodiments of the invention will be apparent from the dependent claims.

The present invention provides a bit design for matrix heights greater than the traditional 12 mm and up to 20-25 mm. The bit matrix is provided with a number of internal and external slots, that extend roughly two-thirds of the way through the matrix annulus. In addition, the number of penetrating liquid conveying slots is restricted to a maximum of four in number. This forces matrix slots that deliver flushing and cooling liquid to function as cooling flanges and to cool down the drill face. Conicity of the inner diameter of the bit is also avoided, which greatly enhances the mechanical strength and stability of the bit owing to the small number of slots provided. This results in optimal length life, function and strength of high matrices.

BRIEF DESCRIPTION OF THE DRAWINGS

The invention will now be described in more detail with reference to exemplifying embodiments thereof and also with reference to the accompanying drawing, in which FIG. 1 is a perspective view of a typical drill bit; and FIG. 2 is a perspective view of a drill bit according to the present invention.

DESCRIPTION OF THE PRESENT INVENTION

FIG. 1 illustrates a casing string R accommodating a typical drill bit 10 that includes an annular matrix that has a material-working bit face 12. The cutting surface 14 of the bit face 12 is divided into a number of sectors by means of through-penetrating radial liquid-delivering slots 16 in the form of cooling/flushing channels that divide the bit face 12. As illustrated by the arrows in FIG. 1, cooling water/flushing water flows through these slots from centre of the bit 10 to its periphery, or possibly in the opposite direction to that shown. This liquid flow cools the bit face and also carries away worked material. Because the slots 16 have the same height as the bit face 12 throughout the whole of their radial extension, the cooling/flushing water will exit through the slots 16 before it has had time to reach the working surface 14 of the bit face at high matrix levels, wherewith the working surface 14 of the bit face be insufficiently cooled and therefore begin to wear at an earlier stage than would otherwise be the case.

FIG. 2 illustrates a casing string R accommodating a drill bit 20 designed in accordance with the present invention. The illustrated bit is typically provided with a material-working bit face 21 that is built-up by a matrix. The matrix is provided with two through-penetrating radial liquid-delivering slots 16 which function as flushing channels on the one hand and as cooling channels on the other. The matrix also includes a first group of internal liquid-delivering slots 23 which in the case of the FIG. 2 embodiment are four in number and which extend radially outwards from the inside 24 of the bit face 21 and which terminate with an inner bottom surface 25 in the face 24. The matrix also includes a group of outer liquid-delivery slots 26, which in the FIG. 2 embodiment are 6 in number. All of these outer slots 26 extend radially inwards from the outside 27 of the bit face 21, said groups terminating with an outer bottom surface 28 in the face 21.

The respective slot bottoms 23, 26 and 25, 28 in the bit face are generally rectangular planar surfaces that are orientated parallel with a contemplated plane in which axial lines A of the bit face extend. Both the inner slot 23 and the outer slot 26 extend radially through the bit face to an extent corresponding to two thirds of the width B of the face 21.

The inner and outer slots 23, 26 that include said bottom surfaces also include respective side surfaces 23*a*, 23*b* and 26*a*, 26*b* which, in the case of the illustrated embodiment extend parallel with one another in respective slots. This parallelism is not necessary in achieving the advantages afforded by the invention, and the slots may alternatively be made wider closer to the inner surface and narrower towards the bottom of the slot, or vice versa.

Liquid flow is achieved by pressing coolant liquid down through the inner slots 23 and in the bit face is forced over to the outer slots 26 and exits therethrough. Thus, the coolant will always pass the bit face 21 and cool it to a maximum. This cooling effect will continue even when the bit face has worn down, since the slots have the same axial extension as the matrix.

According to the present invention, the working surface 22 of the bit face 21 is generally flat, so that the axial line A will extend parallel with a contemplated normal to the working surface 22. The problems mentioned in the introduction are thus solved by providing the matrix with inner slots 23 and outer slots 26, as shown in the accompanying figures. These slots are not through-penetrating but extend into the matrix to an extent corresponding preferably to two thirds of the width of the bit face.

Moreover, the number of deep, through-penetrating slots 16 is limited to a maximum of four slots in respect of bit diameters of up to 60 mm and a maximum of six slots in larger bit diameters.

This forces the water to pass instead via the non-penetrating slots in the matrix and therewith forces the liquid, normally water, right up to the bit working surface 22 therewith cooling said surface. The internal and external slots 23, 26 function as cooling flanges and thereby also enhance cooling of the bit in its entirety.

In addition to the improved cooling advantage that enables a higher matrix to be used, the afore described design of the illustrated embodiment also avoids conicity of the inner diameter due to the fact that the water is able to carry away drill cuttings or drill slime via the internal and external slots.

The invention claimed is:

1. A drill bit for connection to a casing string, wherein the bit comprises an annular bit face which is built-up by a matrix and which comprises a sintered diamond-metal powder mixture, wherein the bit face includes a plurality of radially orientated liquid delivery slots for cooling and cleansing the bit face, and at least two through-penetrating liquid delivery slots, wherein at least two types of liquid delivery slots are provided, each type having slots that are terminated with a bottom in the bit face, characterized in that at least one of the liquid delivery slots is comprised of an inner slot which extends radially outwards from the inside of the bit face, wherein the slot is terminated with an inner bottom in the bit face, and in that a further liquid delivery slot comprises an outer slot that extends radially inwards from the outside of the bit face, wherein said outer slot is terminated with an outer bottom in the bit face, wherein the inner slot and the outer slot extend radially through the bit face to an extent corresponding to two-thirds of the width of the bit face.

2. A drill bit according to claim 1, characterized in that respective slot bottoms in the bit face are comprised of a generally rectangular planar surface orientated parallel with a contemplated plane through the axial line A of the bit face.

3. A drill bit according to claim 1, characterized in that each of all liquid delivery slots has a height which is at least equal to the height of the matrix of the bit face.

4. A drill bit according to claim 1, characterized in that the number of through-penetrating liquid delivery slots is six at a maximum.

5. A drill bit according claim 1, characterized in that the number of inner slots is fewer in number than the number of outer slots.

6. A drill bit according to claim 1, characterized in that the inner slots are at least four in number.

7. A drill bit according to claim 1, characterized in that the outer slots are at least six in number.

* * * * *